United States Patent [19]

Washington

[11] Patent Number: 4,559,737

[45] Date of Patent: Dec. 24, 1985

[54] SNARE DEVICE

[76] Inventor: Richard J. Washington, 14060 Lake Wildwood Dr., Penn Valley, Calif. 95946

[21] Appl. No.: 560,215

[22] Filed: Dec. 12, 1983

[51] Int. Cl.[4] ..... E05G 5/02; F41F 1/00; F42B 13/56

[52] U.S. Cl. ..... 43/59; 42/77; 89/14.05; 102/504; 119/153; 124/1; 124/83

[58] Field of Search ..... 43/58, 59, 19; 446/247; 119/153; 124/1, 41 R, 52, 83; 273/343, 84 R; 102/504; 42/77; 89/14.05

[56] References Cited

U.S. PATENT DOCUMENTS

| | | | |
|---|---|---|---|
| 1,217,415 | 2/1917 | Colomyjczuk | 102/504 |
| 1,276,689 | 8/1918 | Poudrier | 89/14.05 |
| 1,304,857 | 5/1919 | Davis | 102/504 |
| 2,611,340 | 9/1952 | Manning | 43/58 |
| 2,797,924 | 7/1957 | Stewart | 119/153 |
| 3,717,348 | 2/1973 | Bowers | 273/327 |
| 3,869,825 | 3/1975 | Heberlein | 124/52 |

*Primary Examiner*—Gene P. Crosby

*Attorney, Agent, or Firm*—Zarley, McKee, Thomte, Voorhees & Sease

[57] ABSTRACT

A device is provided which enables a person to capture a fugitive without injuring the fugitive. The device comprises a tubular body having angularly disposed tubular barrels extending therefrom. The barrels each have a slot extending along the length thereof such that a pair of projectiles can be loaded into the device while a flexible line interconnects the pair of projectiles.

To catch the fugitive, the device is aimed at the fugitive and the pair of projectiles are propelled from the barrels in diverging lines of flight. As the line extends between the diverging projectiles, the fugitive is engaged by the line. The momentum of the moving projectile causes the projectiles to wrap the line about the fugitive thereby entangling him and preventing him from further fleeing.

18 Claims, 6 Drawing Figures

SNARE DEVICE

BACKGROUND OF THE INVENTION

In police work and the like it is generally desirable to be able to capture a fleeing person without injuring the person. In the past, it has been a problem to catch a fugitive and prevent him from fleeing further without imparting some injury or pain to his body.

Therefore, a primary objective of the present invention is the provision of a device for capturing a fleeing person without injuring the person.

A further objective of the present invention is the provision of a device for entangling a fleeing person such that the person cannot continue to flee.

A further objective of the present invention is the provision of a method of snaring a person who wishes not to be caught.

A further objective of the present invention is the provision of a device and method of using the device for catching a fleeing person, such method and device being durable, safe, and easy to use.

SUMMARY OF THE INVENTION

The device of the present invention generally comprises a Y-shaped member having a tubular body and a pair of angularly disposed tubular barrels extending from the body. Each of the barrels is adapted to receive a projectile, with the pair of projectiles being interconnected by a flexible line. The body of the Y-shaped member is attached to a means for projecting the projectiles. A pair of stacks can be mounted upon the barrels for storage of additional projectiles.

In operation, the device is aimed at a fleeing person and the projecting means is actuated such that the projectiles are propelled towards the person. The projectiles diverge from one another as they move towards the target while the flexible line between them is extended. When the line contacts the person, the momentum of the projectiles causes them to wrap the line about the person's body such that he is entangled in the line and incapable of fleeing further.

DETAILED DESCRIPTION OF THE DRAWINGS

Figure 1:
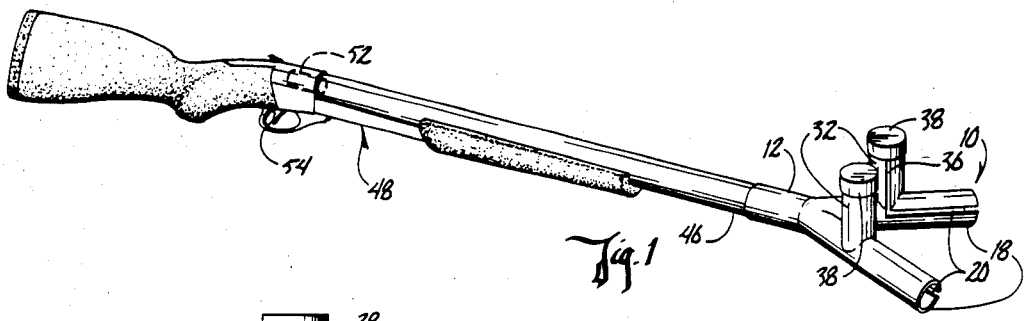
FIG. 1 is a perspective view of the device mounted on a rifle.
Figure 2:
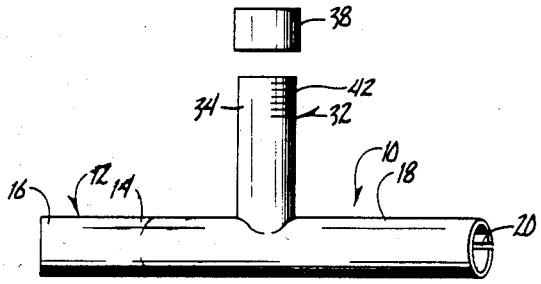
FIG. 2 is a side elevational view of the device.
Figure 5:
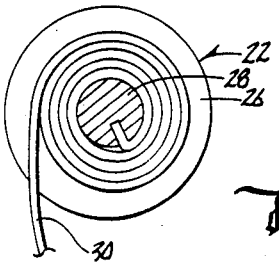
FIG. 5 is a top plan view of the projectile taken along line 5—5 of FIG. 4.
Figure 3:
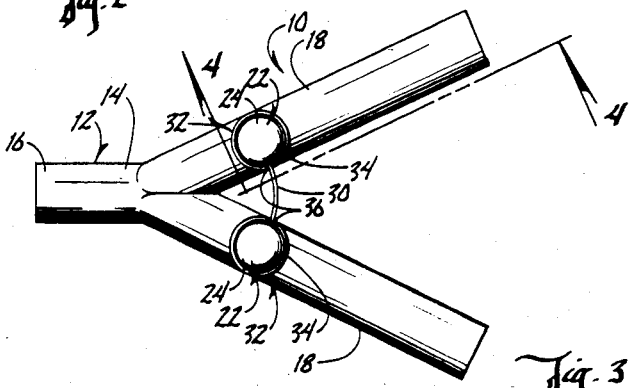
FIG. 3 is a top plan view of the device.
Figure 4:
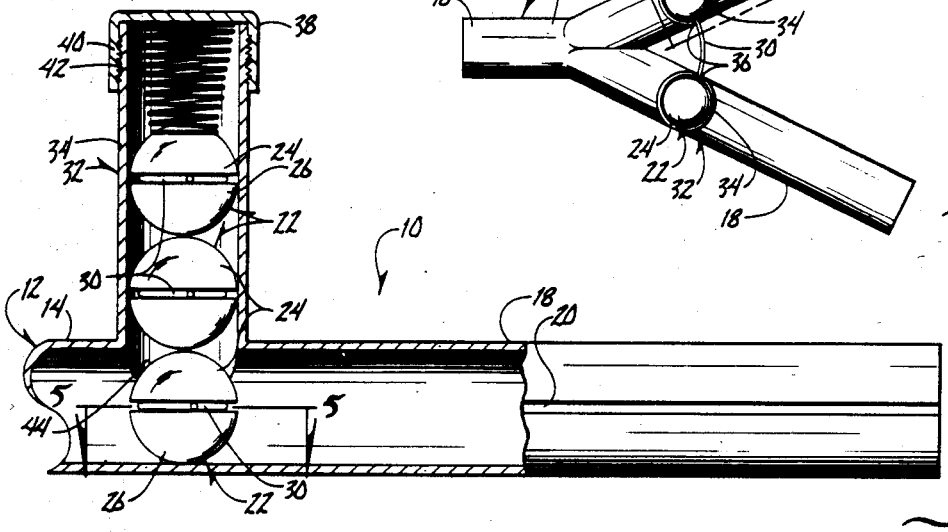
FIG. 4 is a partial sectional view taken along line 4—4 of FIG. 3.
Figure 6:
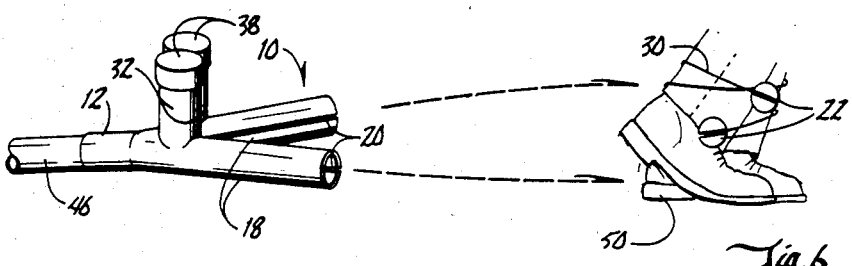
FIG. 6 is a view showing the operation of the device.

The device of the present invention is generally designated by the numeral 10. The device is comprised of a main tubular body 12 having opposite ends 14 and 16 and a pair of tubular barrels 18, each connected to end 14 of body 12 and being angularly disposed with respect to one another such that device 10 has a general Y-shaped configuration. A slot 20 extends through the wall of each barrel 18 along the length thereof such that the slots oppose one another.

A pair of projectiles 22 are comprised of opposite hemispherical sectional 24 and 26 which are joined by connecting member 28. As assembled, the projectiles resemble a yo-yo. A flexible line 30 interconnects the two projectiles and can be wound about connecting member 28 so that the distance between the projectiles can be varied.

Device 10 may also include a storage compartment, generally designated by numeral 32, for additional projectiles. Storage compartment 32 includes a tubular stack 34 on each of barrels 18. A slot 36 extends through the wall of each stack 34 along the length thereof such that the slots oppose one another. Slots 36 are adapted to receive line 30 when the pair of projectiles 22 are stored within tubular stacks 34. Similarly, when the pair of projectiles 22 are in position within tubular barrels 18, line 30 extends through slots 20 in each of barrels 18.

A cap 38 may be provided to cover the top of each stack 34. Cap 38 may be secured to stacks 34 in any convenient manner, such as interior threads 40 which mate with exterior threads 42 on stacks 34.

An opening 44 is provided in each barrel 18 so as to provide communication between the interior of barrel 18 and stack 34. Opening 44 thus permits additional pairs of projectiles 22 stored within stacks 34 to drop one pair at a time into the interior of barrels 18 for automatic repetetive loading of device 10. A spring 45 may also be mounted on the interior of cap 38 to assist the sequential loading of projectiles 22 from stacks 34 into barrels 18.

End 16 of body 12 is adapted to receive the barrel 46 of a gun 48. End 16 can be secured to gun barrel 46 by any convenient means. The gun may be a rifle or a handgun.

To use the device, a pair of projectiles 22 are loaded into barrels 18 such that line 30 extends between the pair of projectiles 22 and through slots 20 in barrels 18. Device 10 is then aimed at a fleeing person 50 who is sought to be captured. A means 52 for projecting projectiles 22 is actuated within gun 48 by trigger 54. Means 52 may be any conventional means for imparting a propelling force to projectiles 22, such as a blast of air from a $CO_2$ cartridge, an explosive charge, or a compressed spring. When propelling means 52 is actuated, projectiles 22 are forced outwardly from barrels 18 in diverging lines of flight. As projectiles 22 converge upon the person to be caught, the space between the two projectiles increases while line 30 unwinds from connecting member 28 on each projectile. When line 30 initially contacts the person to be caught and the pair of projectiles 22 have extended to the ends of line 30, the momentum of the projectiles causes them to wrap the line about the body of person 50 so as to entangle the person and prevent him from fleeing further.

The extension of line 30 during the diverging flight of the pair of projectiles 22 enables a person to be caught even if the person moves or changes directions slightly after the projectiles have been fired from barrels 18. Extension of line 30 also makes possible the utilization of the momentum of the moving projectiles to entangle the person within line 30. Line 30 should be of a lightweight material such as filament line or the like which will not injure the person being snared.

It can be seen from the foregoing that the device of the present invention accomplishes at least all of the stated objectives.

What is claimed is:

1. A snare device for use with a projection means comprising:

a Y-shaped member having a tubular body with opposite forward and rearward ends, said rearward end being in communication with said projection means, and two angularly disposed tubular barrels extending forwardly from said forward end of said body, a pair of slotted projectiles each having a central axis and being interconnected by a flexible line having opposite ends wound around said slotted projectiles prior to projection of said projectiles from said tubular barrels;

one of said projectiles being received in each of said tubular barrels for projection therefrom whereby said projectiles move in diverging paths and rotate about their central axes so as to unwind said flexible line, the momentum of said projectiles causing said projectiles and said line to wrap around said object upon engagement of said line on said object.

2. The device of claim 1 wherein upon projection from said tubular barrels, said projectiles diverge from one another to unwind said flexible line.

3. The device of claim 1 wherein each of said tubular barrels have a slot therethrough extending along the length thereof for receiving said line.

4. The device of claim 1 further comprising storage chamber for storing additional pairs of projectiles.

5. The device of claim 4 wherein said storage chamber includes a pair of tubular stacks, one of said stacks being mounted on each of said tubular barrels, said stacks having upper and lower ends.

6. The device of claim 5 wherein each of said stacks receives one projectile of said pair of projectiles and each stack includes a slot therethrough extending the length thereof for receipt of said line.

7. The device of claim 6 wherein each of said tubular barrels are in communication with one of said stacks for receiving said one projectile of said pair of projectiles from said lower end of said stack mounted thereon.

8. The device of claim 7 wherein each of said stacks includes an upper cap for closing said upper end of said stacks.

9. The device of claim 1 wherein said projection means is a pressurized air cartridge.

10. The device of claim 1 wherein said projection means is an explosive charge.

11. The device of claim 1 wherein said projection means is a compressed spring.

12. The device of claim 1 wherein said line is lightweight so as not to injure said person entangled therein.

13. The device of claim 1 wherein each of said slotted projectiles includes a slot extending around the perimeter thereof, said flexible line being wound around said projectile within said slot prior to projection from said tubular barrels.

14. The device of claim 1 wherein each of said projectiles includes a pair of spaced apart hemispherical sections interconnected by a central connecting member.

15. A snare device for use with a projection means comprising:

a Y-shaped member having a tubular body with opposite forward and rearward ends, said rearward end being in communication with said projection means, and two angularly disposed tubular barrels extending forwardly from said forward end of said body, a pair of non-explosive projectiles interconnected by a flexible line, one of said projectiles being received in each of said tubular barrels for projection therefrom whereby said projectiles move outwardly away from one another until said line engages an object to cause said projectiles and said line to wrap around said object;

each of said projectiles including a slot extending around the perimeter thereof, said flexible line being wound around said projectile within said slot prior to projection from said tubular barrels.

16. A snare device for use with a projection means comprising:

a Y-shaped member having a tubular body with opposite forward and rearward ends, said rearward end being in communication with said projection means, and two angularly disposed tubular barrels extending forwardly from said forward end of said body, a pair of non-explosive projectiles interconnected by a flexible line, one of said projectiles being received in each of said tubular barrels for projection therefrom whereby said projectiles move outwardly away from one another until said line engages an object to cause said projectiles and said line to wrap around said object;

each of said projectiles including a pair of spaced apart hemispherical sections interconnected by a central connecting member.

17. The device of claim 16 wherein said flexible line has opposite ends wound around said central connecting member of each projectile prior to projection of said projectiles from said tubular barrels.

18. The device of claim 17 wherein each of said projectiles rotates about said central connecting member upon projection from said tubular barrels such that said flexible line unwinds from said central connecting members as said projectiles diverge from one another.

* * * * *